US010050335B2

(12) United States Patent
Lee et al.

(10) Patent No.: US 10,050,335 B2
(45) Date of Patent: Aug. 14, 2018

(54) ELECTRONIC DEVICE WITH ANTENNA HAVING RING-TYPE STRUCTURE

(71) Applicant: Samsung Electronics Co., Ltd., Gyeonggi-do (KR)

(72) Inventors: Woo-Sup Lee, Gyeonggi-do (KR); Gyu-Sub Kim, Seoul (KR); Yeon-Woo Kim, Gyeonggi-do (KR); Jung-Sik Park, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/479,450

(22) Filed: Apr. 5, 2017

(65) Prior Publication Data

US 2017/0207518 A1 Jul. 20, 2017

Related U.S. Application Data

(63) Continuation of application No. 14/737,825, filed on Jun. 12, 2015, now Pat. No. 9,647,323.

(30) Foreign Application Priority Data

Jun. 23, 2014 (KR) ..... 10-2014-0076496

(51) Int. Cl.

| | |
|---|---|
| ***H01Q 1/24*** | (2006.01) |
| ***H01Q 9/42*** | (2006.01) |
| ***H01Q 1/36*** | (2006.01) |
| ***H01Q 1/48*** | (2006.01) |
| *H01Q 9/04* | (2006.01) |

(52) U.S. Cl.
CPC ..... *H01Q 1/243* (2013.01); *H01Q 1/36* (2013.01); *H01Q 1/48* (2013.01); *H01Q 9/0485* (2013.01); *H01Q 9/42* (2013.01); *H01Q 9/0421* (2013.01)

(58) Field of Classification Search
CPC .... H01Q 9/0464; H01Q 19/005; H01Q 1/243; H01Q 9/42; H01Q 9/0421
USPC ..... 343/711, 702
See application file for complete search history.

(56) References Cited

U.S. PATENT DOCUMENTS

| | | | | |
|---|---|---|---|---|
| 6,697,024 | B2 | 2/2004 | Fuerst et al. | |
| 2003/0054855 | A1* | 3/2003 | Kojola | H01Q 1/084 455/550.1 |
| 2011/0136447 | A1 | 6/2011 | Pascolini et al. | |
| 2012/0175165 | A1 | 7/2012 | Merz et al. | |
| 2012/0195011 | A1 | 8/2012 | Wong et al. | |

(Continued)

FOREIGN PATENT DOCUMENTS

CN 104064866 A 9/2014

*Primary Examiner* — Jean B Jeanglaude
(74) *Attorney, Agent, or Firm* — Cha & Reiter, LLC.

(57) ABSTRACT

In one embodiments, an electronic device including an antenna with a ring-type structure is disclosed. The electronic device includes a metal bracket and the antenna. The antenna includes a first metal ring surrounding the metal bracket, where the first metal ring has at least two sections separated by at least one gap. At least one section may operate as a radiator through radio frequency (RF) feeding at least at one portion thereof. A second metal ring may be electrically connected, at least at one point thereof, to a ground of the electronic device or to the first metal ring. At least one section of the first metal ring may operate as a monopole antenna, as a PIFA antenna, or as a loop antenna, via suitable feeding.

21 Claims, 9 Drawing Sheets

(56) References Cited

U.S. PATENT DOCUMENTS

| | | | | |
|---|---|---|---|---|
| 2013/0169504 | A1* | 7/2013 | Jenwatanavet ..... | H01Q 1/242<br>343/848 |
| 2014/0111388 | A1 | 4/2014 | Di Nallo et al. | |
| 2014/0132456 | A1 | 5/2014 | Wang et al. | |
| 2014/0354491 | A1 | 12/2014 | Kim et al. | |

* cited by examiner

ELECTRONIC DEVICE WITH ANTENNA HAVING RING-TYPE STRUCTURE

CROSS REFERENCE TO RELATED APPLICATIONS

This application is a Continuation of U.S. patent application Ser. No. 14/737,825 filed on Jun. 12, 2015 which claims the benefit under 35 U.S.C. § 119(a) of a Korean patent application filed in the Korean Intellectual Property Office on Jun. 23, 2014 and assigned Serial No. 10-2014-0076496, the entire disclosure of which is hereby incorporated by reference.

BACKGROUND

1. Technical Field

The present disclosure relates generally to an electronic device and an antenna for an electronic device, and more particularly to an antenna suitable for a portable electronic device such as a hand held electronic device.

2. Description of the Related Art

With recent technical advances, commercialized portable electronic devices (also referred to generally as mobile communication devices) may include a wireless communication function operating in several frequency bands. Consumers who use a portable electronic device demand a smaller device having various functions. To satisfy consumer demand, manufacturers continually strive to reduce the size of components used in the portable electronic device and to integrate several functions using one component.

The effort to reduce the space requirements for components is equally made for the portable device antenna used to transmit and receive radio waves. For example, there is ongoing work to develop an antenna that fits within a small space of an electronic device while smoothly operating in various frequency bands.

In general, a portable electronic device may include at least one built-in antenna. Since the built-in antenna does not protrude to an outside of the electronic device, an external appearance is enhanced. Disadvantageously, however, a performance-to-size relation cannot be designed in a complementary manner. In particular, when a metal construction and a metal component are located near the antenna, there is a problem in that the antenna's radiation efficiency is decreased and a requisite performance over a desired band or bands is also diminished.

A conventional portable electronic device typically has sufficient space for housing an antenna and a sufficient separation distance to a metal portion of the device. An exterior of the portable electronic device is formed with a dielectric material such as plastic in general. Thus for larger devices, the antenna design did not pose significant problems. However, with the trend towards smaller and thinner devices, a space for placing the antenna has been more and more constrained, and a distance to a surrounding metal construction and metal component is becoming increasingly closer.

The aforementioned metal structure significantly contributes to not only improving mechanical robustness but also enhancing an external appearance and slimming down the device in size. Therefore, efforts are ongoing to apply this structure to a part of the electronic device, in particular, to a frame of the device.

However, it is difficult for the aforementioned conventional general built-in antenna to satisfy a requirement of a compact size, efficiency increase, and a wide band in such extreme surrounding conditions. In an attempt to solve this problem, conventional methods have: i) arranged a patterned conductor comprising the antenna radiator at a location spaced apart from a metal construction by a maximum distance possible in a narrow space allocated for the antenna; ii) processed a metal construction proximate to where the antenna is located with insert molding, or iii) increase a thickness of region of the electronic device where the antenna is located. However, in the first approach, there is a limit to how close the radiator can be to the metal construction and also effectively operate, which limits the ability to shrink the electronic device size and/or thickness. In addition, a method of performing an insert molding process on an antenna part impairs an external appearance of the antenna since there is a disparity between metal and insert molding processes in a design aspect even if it is easy to ensure radiation efficiency.

When the aforementioned metal construction is placed in a front surface of the portable device, it has been used by being connected to a main ground. However this arrangement typically results in a radiation deterioration phenomenon. That is, if there is a metal structure extended from the ground near the antenna, near field radio frequency (RF) energy induces current in a corresponding metal member and generates thermal loss and radiation loss together with lossy volume, thereby resulting in overall radiation efficiency deterioration.

To solve such problems, a method has been used in which a metal portion of an antenna is processed with insert molding and the remaining portions of a front surface of the antenna are subjected to metal processing. However, this method has a problem in that a disparity occurs between metal and insert molding processes in a design aspect.

SUMMARY

Various exemplary embodiments of the present disclosure may provide an electronic device which utilizes an antenna with a ring-type structure that serves as a part of an external appearance or as part of a housing of the electronic device.

According to various exemplary embodiments, there is provided an electronic device that includes a metal bracket and an antenna. The antenna may include a first metal ring surrounding the metal bracket, where the first metal ring may have at least two sections separated by at least one gap. At least one section may operate as a radiator through radio frequency (RF) feeding at least at one portion thereof. A second metal ring may be electrically connected, at least at one point thereof, to a ground of the electronic device or to the first metal ring.

According to various exemplary embodiments, the electronic device may further include a display which is supported by the metal bracket. The electronic device may further include a substrate including an antenna feeder for feeding the first metal ring, so that the first metal ring operates as a radiator. At least one section of the first metal ring may operate as a monopole antenna, as a PIFA antenna, or as a loop antenna, via suitable feeding.

BRIEF DESCRIPTION OF THE DRAWINGS

The above and other aspects, features and advantages of certain exemplary embodiments of the present disclosure will be more apparent from the following detailed description taken in conjunction with the accompanying drawings, in which.

DETAILED DESCRIPTION

Figure 1:
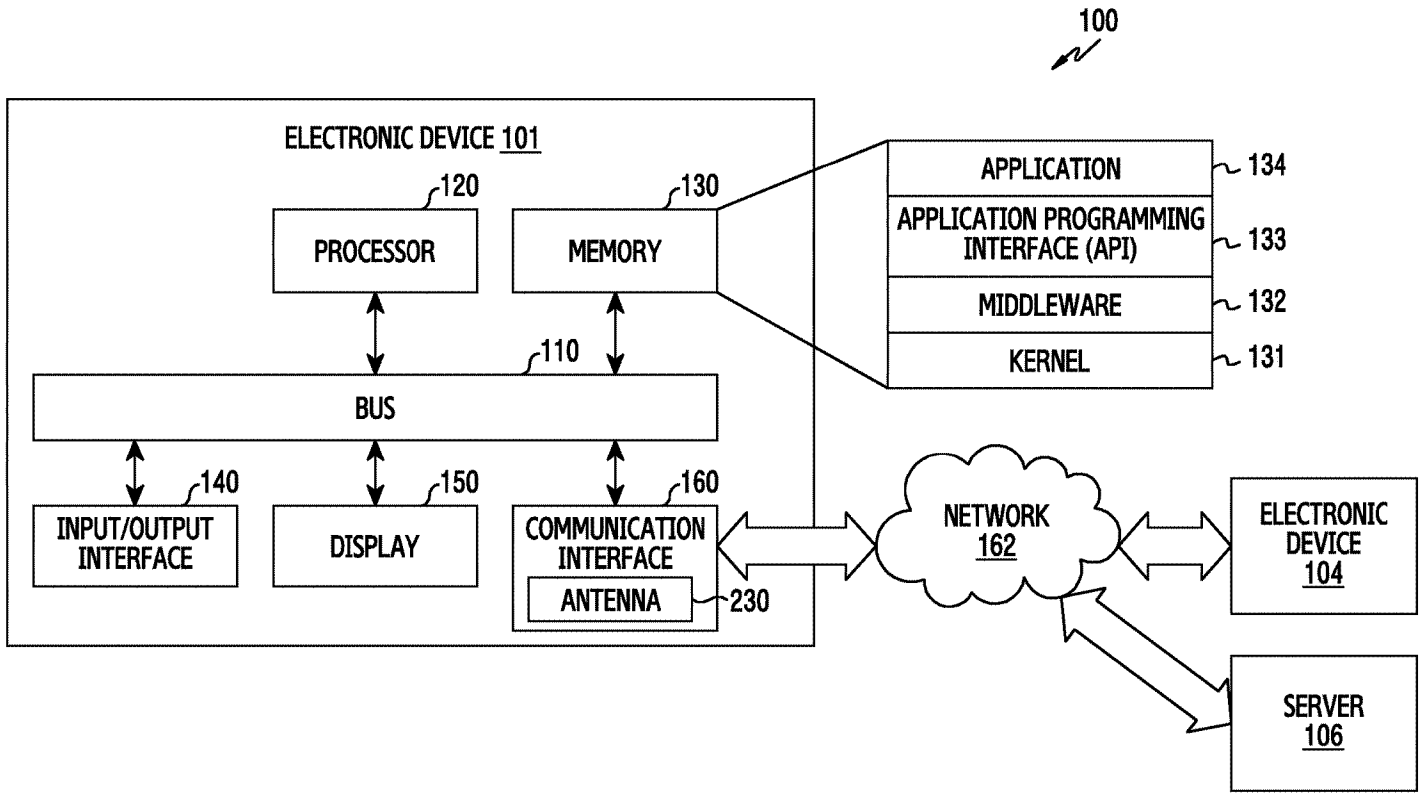
FIG. 1 illustrates a network environment including an electronic device according to various exemplary embodiments of the present disclosure.

Hereinafter, various exemplary embodiments of the present disclosure are described with reference to the accompanying drawings. While the various exemplary embodiments of the present disclosure are susceptible to various modifications and alternative forms, a specific embodiment thereof has been shown by way of example in the drawings and will herein be described in detail. It should be understood, however, that it is not intended to limit the various exemplary embodiments of the present disclosure to the particular form disclosed, but, on the contrary, the various exemplary embodiments of the present disclosure are to cover all modifications, equivalent, and alternatives falling within the spirit and scope of the various exemplary embodiments of the present disclosure as defined by the appended claims. Like reference numerals denote like constitutional elements throughout the drawings.

The expression "include" or "may include" used in the various exemplary embodiments of the present disclosure is intended to indicate a presence of a corresponding function, operation, or constitutional element disclosed herein, and it is not intended to limit a presence of one or more functions, operations, or constitutional elements. In addition, in the various exemplary embodiments of the present disclosure, the term "include" or "have" is intended to indicate that characteristics, numbers, steps, operations, constitutional elements, and elements disclosed in the specification or combinations thereof exist. As such, the term "include" or "have" should be understood that there are additional possibilities of one or more other characteristics, numbers, steps, operations, constitutional elements, elements or combinations thereof.

In various exemplary embodiments of the present disclosure, an expression "or" includes any and all combinations of words enumerated together. For example, "A or B" may include A or B, or may include both of A and B.

Although expressions used in various exemplary embodiments of the present disclosure such as "$1^{st}$", "$2^{nd}$", "first", "second" may be used to express various constitutional elements of the various exemplary embodiments, it is not intended to limit the corresponding constitutional elements. For example, the above expressions are not intended to limit an order or an importance of the corresponding constitutional elements. The above expressions may be used to distinguish one constitutional element from another constitutional element. For example, a $1^{st}$ user device and the $2^{nd}$ user device are both user devices, and indicate different user devices. For example, a $1^{st}$ constitutional element may be termed a $2^{nd}$ constitutional element, and similarly, the $2^{nd}$ constitutional element may be termed the $1^{st}$ constitutional element without departing from the scope of the various exemplary embodiments of the present disclosure.

When a constitutional element is mentioned as being "connected" to or "accessing" another constitutional element, this may mean that it is directly connected to or accessing the other constitutional element, but it is to be understood that there are no intervening constitutional elements present. On the other hand, when a constitutional element is mentioned as being "directly connected" to or "directly accessing" another constitutional element, it is to be understood that there are no intervening constitutional elements present.

By the term "substantially" it is typically meant that the recited characteristic, parameter, or value need not be achieved exactly, but that deviations or variations, including but in no way limited to, for example, tolerances, measurement error, measurement accuracy limitations and other factors known to persons of ordinary skill in the art, may occur in amounts that do not preclude the effect the characteristic was intended to provide.

The terminology used in various exemplary embodiments of the present disclosure is for the purpose of describing particular exemplary embodiments only and is not intended to be limiting of the various exemplary embodiments of the present disclosure. A singular expression includes a plural expression unless there is a contextually distinctive difference therebetween.

Unless otherwise defined, all terms (including technical and scientific terms) used herein have the same meaning as commonly understood by those ordinarily skilled in the art to which various exemplary embodiments of the present disclosure belong. It will be further understood that terms, such as those defined in commonly used dictionaries, should be interpreted as having a meaning that is consistent with their meaning in the context of the relevant art and the various exemplary embodiments of the present disclosure, and will not be interpreted in an idealized or overly formal sense unless expressly so defined herein.

An electronic device according to various exemplary embodiments of the present disclosure may be a device including an antenna capable of performing a communication function in at least one frequency band. For example, the electronic device may be a smart phone, a tablet Personal Computer (PC), a mobile phone, a video phone, an e-book reader, a desktop PC, a laptop PC, a netbook computer, a Personal Digital Assistant (PDA), a Portable Multimedia Player (PMP), a MPEG-1 Audio Layer 3 (MP3) player, a mobile medical device, a camera, and a wearable device (e.g., a Head-Mounted-Device (HMD) such as electronic glasses, electronic clothes, an electronic bracelet, an electronic necklace, an electronic appcessory, an electronic tattoo, or a smart watch).

According to certain exemplary embodiments, the electronic device may be a smart home appliance having an antenna. For example, the smart home appliance may include at least one of a TeleVision (TV), a Digital Video Disk (DVD) player, an audio, a refrigerator, an air conditioner, a cleaner, an oven, a microwave oven, a washing machine, an air purifier, a set-top box, a TV box (e.g., Samsung HomeSync™, Apple TV™, or Google TV™), a game console, an electronic dictionary, an electronic key, a camcorder, and an electronic picture frame.

According to certain exemplary embodiments, the electronic device including the antenna may be one of various medical devices (e.g., Magnetic Resonance Angiography (MRA), Magnetic Resonance Imaging (MRI), Computed Tomography (CT), imaging equipment, ultrasonic instrument, etc.), a navigation device, a Global Positioning System (GPS) receiver, an Event Data Recorder (EDR), a Flight Data Recorder (FDR), a car infotainment device, an electronic equipment for ship (e.g., a vessel navigation device, a gyro compass, etc.), avionics, a security device, a car head unit, an industrial or domestic robot, an Automatic Teller's Machine (ATM) of financial institutions, and Point Of Sales (POS) of shops.

According to certain exemplary embodiments, the electronic device may be part of at least one of an item of furniture or a building/structure including an antenna. The electronic device may be an electronic board, an electronic signature input device, a projector, or any of various measurement machines (e.g., water supply, electricity, gas, propagation measurement machine, etc.). The electronic device may be one or more combinations of the aforementioned various devices. In addition, the electronic device may be a flexible device. Moreover, the electronic device is not limited to the aforementioned devices.

Hereinafter, an electronic device according to various exemplary embodiments will be described with reference to the accompanying drawings. The term 'user' used in the various exemplary embodiments may refer to a person who uses the electronic device or a device which uses the electronic device (e.g., an Artificial Intelligence (AI) electronic device).

FIG. 1 illustrates a network environment 100 including an electronic device 101 according to various exemplary embodiments. Electronic device 101 may include a bus 110, a processor 120, a memory 130, an input/output interface 140, a display 150, and a communication interface 160.

The bus 110 may be a circuit for connecting the aforementioned constitutional elements to each other and for delivering communication (e.g., a control message) between the aforementioned constitutional elements.

The processor 120 may receive an instruction from the aforementioned different constitutional elements (e.g., the memory 130, the input/output interface 140, the display 150, the communication interface 160, etc.), for example, via the bus 110, and thus may interpret the received instruction and execute arithmetic or data processing according to the interpreted instruction.

The memory 130 may store an instruction or data received from the processor 120 or different constitutional elements (e.g., the input/output interface 140, the display 150, the communication interface 160, etc.) or generated by the processor 120 or the different constitutional elements. The memory 130 may include programming modules such as a kernel 131, a middleware 132, an Application Programming Interface (API) 133, an application 134, and the like. Each of the aforementioned programming modules may consist of software, firmware, or hardware entities or may consist of at least two or more combinations thereof.

The kernel 131 may control or manage the remaining other programming modules, for example, system resources (e.g., the bus 110, the processor 120, the memory 130, etc.) used to execute an operation or function implemented in the middleware 132, the API 133, or the application 134. In addition, the kernel 131 may provide a controllable or manageable interface by accessing individual constitutional elements of the electronic device 101 in the middleware 132, the API 133, or the application 134.

The middleware 132 may perform a mediation role so that the API 133 or the application 134 communicates with the kernel 131 to exchange data. In addition, regarding task requests received from the application 134, for example, the middleware 132 may perform a control (e.g., scheduling or load balancing) for the task requests by using a method of assigning a priority capable of using a system resource (e.g., the bus 110, the processor 120, the memory 130, etc.) of the electronic device 101 to at least one of the applications 134.

The API 133 may include at least one interface or function (e.g., instruction) for file control, window control, video processing, character control, and the like, as an interface capable of controlling a function provided by the application 134 in the kernel 131 or the middleware 132.

The application 134 may include an Short Message Service (SMS)/Multimedia Messaging Service (MMS) application, an e-mail application, a calendar application, an alarm application, a health care application (e.g., an application for measuring a physical activity level, a blood sugar, etc.) or an environment information application (e.g., atmospheric pressure, humidity, or temperature information). Additionally or alternatively, the application 134 may be an application related to an information exchange between the electronic device 101 and an external electronic device (e.g., an electronic device 104 or server 106). The application related to the information exchange may include, for example, a notification relay application for relaying specific information to the external electronic device or a device management application for managing the external electronic device.

For example, the notification relay application may include a function of relaying notification information generated in another application (e.g., an SMS/MMS application, an e-mail application, a health care application, an environment information application, etc.) of the electronic device 101 to the external electronic device. Additionally or alternatively, the notification relay application may receive notification information, for example, from the external electronic device and may provide it to the user. The device management application may manage, for example, a function for at least one part of the external electronic device which communicates with the electronic device 101. Examples of the function include turning on/turning off the external electronic device itself (or some components thereof) or adjusting of a display illumination (or a resolution), and managing (e.g., installing, deleting, or updating) an application which operates in the external electronic device or a service (e.g., a call service or a message service) provided by the external electronic device.

The application 134 may include an application specified according to attribute information (e.g., an electronic device type) of the external electronic device. For example, if the external electronic device is an MP3 player, the application 134 may include an application related to a music play. Similarly, if the external electronic device is a mobile medical device, the application 134 may include an application related to a health care. The application 134 may include at least one of a specified application in the electronic device 101 or an application received from the external electronic device.

The input/output interface 140 may relay an instruction or data input from a user by using a sensor (e.g., an acceleration sensor, a gyro sensor) or an input device (e.g., a keyboard or a touch screen) to the processor 120, the memory 130, or the communication interface 160, for example, via the bus 110. For example, the input/output interface 140 may provide data regarding a user's touch input via the touch screen to the processor 120. In addition, the input/output interface 140 may output an instruction or data received from the processor 120, the memory 130, or the communication interface 160 to an output device (e.g., a speaker or a display), for example, via the bus 110. For example, the input/output interface 140 may output audio data provided by using the processor 120 to the user via the speaker.

The display 150 may display a variety of information (e.g., multimedia data or text data) to the user.

The communication interface 160 may connect a communication between the electronic device 101 and an external device (e.g., the electronic device 104 or the server 106). The communication interface 160 may include an antenna 230, examples of which are described hereinafter. For example, the communication interface 160 may communicate with the external device by being connected with a network 162 through wireless communication or wired communication. The wireless communication may include, for example, at least one of Wireless Fidelity (Wi-Fi), Bluetooth (BT), Near Field Communication (NFC), Global Positioning System (GPS), and cellular communication (e.g., LTE, LTE-A, CDMA, WCDMA, UMTS, WiBro, GSM, etc.). The wired communication may include, for example, at least one of Universal Serial Bus (USB), High Definition Multimedia Interface (HDMI), Recommended Standard (RS)-232, and Plain Old Telephone Service (POTS).

The network 162 may be a telecommunications network. The telecommunications network may include at least one of a computer network, an internet, an internet of things, and a telephone network. A protocol (e.g., a transport layer protocol, a data link layer protocol, or a physical layer protocol) for communication between the electronic device 101 and an external device may be supported in at least one of the application 134, the application programming interface 133, the middleware 132, the kernel 131, and the communication interface 160.

An antenna described hereinafter is implemented as a ring-type antenna formed around an edge which is a contributing factor to an external appearance, particularly, to a thickness of an electronic device. However, the antenna is not limited thereto. For example, a ring-type antenna disposed in various manners at various positions of the electronic device may be utilized as the antenna. In addition, the term "ring-type" is used herein to refer to a general configuration of the antenna structure. That is, the term "ring-type" is used to denote a ring-like structure, and not necessarily a ring or loop type of antenna. A portion of the "ring-type antenna" may be used to realize various types of antennas such as a monopole antenna or an Inverted F antenna (IFA), explained further below.

Figure 2A:
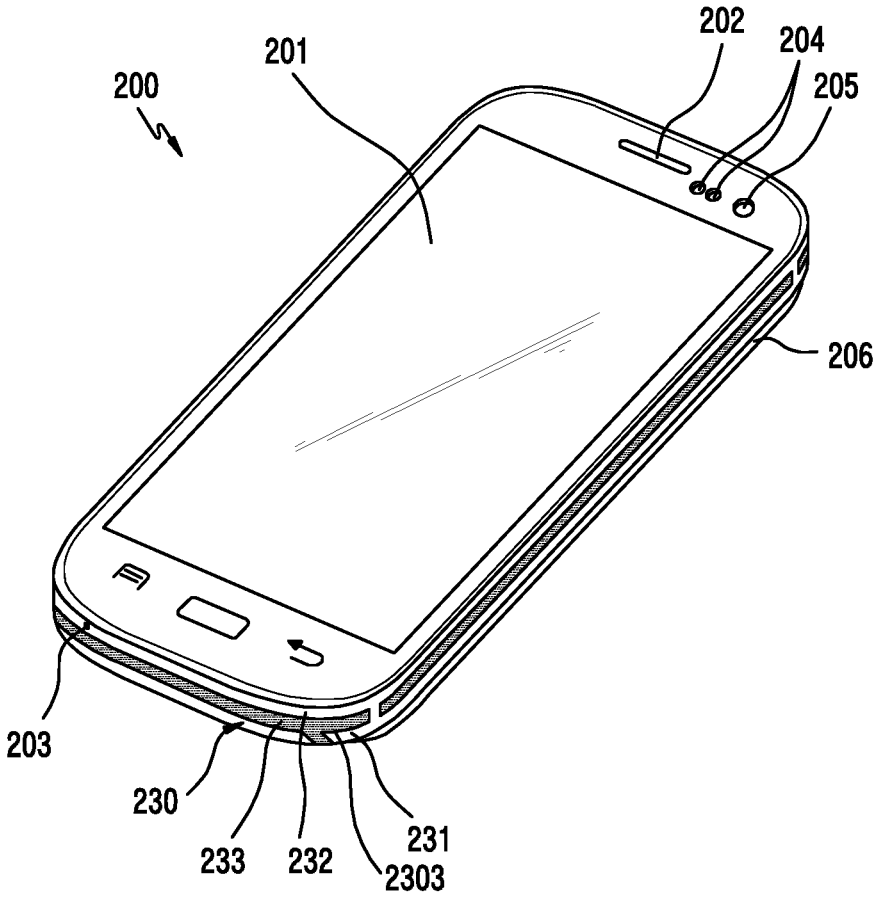
FIG. 2A is a perspective view of an electronic device according to various exemplary embodiments of the present disclosure.

FIG. 2A is a perspective view of an electronic device 200 according to various exemplary embodiments of the present disclosure. Electronic device 200 may be an example of electronic device 101 of FIG. 1; similar or identically named components of FIG. 2 may be considered examples of those described in connection with FIG. 1.

As shown in FIG. 2, a display 201 may be installed to a front surface of the electronic device 200. A speaker 202 for receiving a voice of a peer user may be installed to an upper portion of the display 201. A microphone 203 for transmitting a voice of a user of the electronic device to the peer user may be installed to a lower portion of the display 201.

Electronic device 200 may be a "bar shaped" electronic device, e.g. having the general shape of a substantially rectangular parallelepiped with or without rounded corners as illustrated in FIG. 2A. Front and rear sides of device 200 may be substantially planar. Hereafter, a dimension of electronic device 200 orthogonal to both width and length dimensions is referred to as the thickness direction, or the vertical direction with the assumption that device 200 is placed with its rear side oriented horizontally. As such, "height" will refer to a relative distance in the vertical direction. For instance, in FIG. 2A, a first metal ring 231 surrounding the device 200 near its rear surface is said to be disposed at a lower height than a second metal ring 232 surrounding device 200 near the front surface.

Components for performing various functions of the electronic device 200 may be placed near an area in which the speaker 202 is installed. The components may include a camera 205. Further, the components may include, for example, at least one sensor module 204. The sensor module 204 may include, for example, an illumination sensor (e.g., an optical sensor) and/or a proximity sensor (e.g., a capacitive sensor), and the like. Although not shown, the components may further include, for example, at least one Light Emitting Diode (LED) indicator.

A ring-type antenna 230 may be provided as an antenna of the electronic device 200 around the periphery of device 200. By disposing antenna 230 in this manner, space which would otherwise be necessary for housing an antenna inside the device 200 may be eliminated, which may be a contributing factor in reducing the thickness of device 200. The ring-type antenna 230 may comprise the first metal ring 231 together with the second metal ring 232. The first and second metal rings 231, 232 may have substantially the same circumferential dimensions. As illustrated in FIG. 2A, the rings 231, 232 may be arranged concentrically in a stacked configuration but separated in the vertical direction by a specific distance, which may be uniform throughout the entire structure of device 200. (The specific distance may correspond to a thickness dimension of a filler 233 disposed between the rings.) Stated differently, the first metal ring 231 and the second metal ring 232 may completely overlay one another from the vantage point of a front view of the device (i.e., as viewed from a point in front of the display 201). (In other embodiments, the rings may be designed with different circumferential dimensions and/or may not overlay one another.) Additionally, filler 233 which may be made of a non-conductive material may be disposed between the rings 212, 232. The filler 233 may be a non-conductive dielectric material (e.g., Poly-Carbonate (PC)). The filler 233 may be disposed between the first metal ring 231 and the second metal ring 232 in an insert molding manner. The filler 233 and the first and second metal rings 231 and 232 may be arranged to be exposed to an exterior of the electronic device 200 and thus may be utilized as an ornament member.

The first metal ring 231 and the second metal ring 232 of antenna 230 may be formed in an integral manner. The rings 231, 232 may be formed to be connected by means of at least one connection portion (see 2302 of FIG. 4). Any one of the first metal ring 231 and the second metal ring 232 may be formed with two or more separate sections by the use of at least one specific gap 2303 (also seen in FIG. 4). This ring will hereafter be referred to as the "discontinuous ring". The filler 233 may also be filled in the gap. The remaining one metal ring without the gap may have a closed loop structure.

Hereafter, this ring will be referred to as the "continuous ring". In the example of FIG. 2A, the first ring 231 is shown as a ring of several separated sections while the second ring 232 is a continuous ring; however, in other embodiments, the second ring 232 may have separated sections and be the discontinuous ring while the first ring 231 may be the continuous ring.

According to various exemplary embodiments of the present disclosure, radiation/resonance of antenna 230 is attained via strategic connection of designated points on the rings 231, 232 to connection points of a transmission line transmitting/receiving an RF signal. Radiation through the rings 231, 232 may be accomplished in a number of ways, depending on how the transmission line connection is made. For instance, radiation may be achieved by the metal ring 231 including the gap, and a loop-type antenna operating in at least one frequency band may be formed. Radiation may be achieved by a coupling operation between the continuous metal ring and the discontinuous metal ring.

As noted above, the first metal ring 231 and the second metal ring 232 may be formed to have the same shape in general, and may be disposed in a separated but overlapping manner. The metal ring 232 not including the gap may be formed in an integral manner with a metal bracket 220 (shown in FIGS. 3 and 4) installed to the electronic device 200, or may be disposed in a floating manner relative to the metal bracket 220. The metal bracket 220 may be utilized as a ground means of an antenna, together with a ground surface of a substrate (see 210 of FIG. 2), or individually.

Figure 2B:
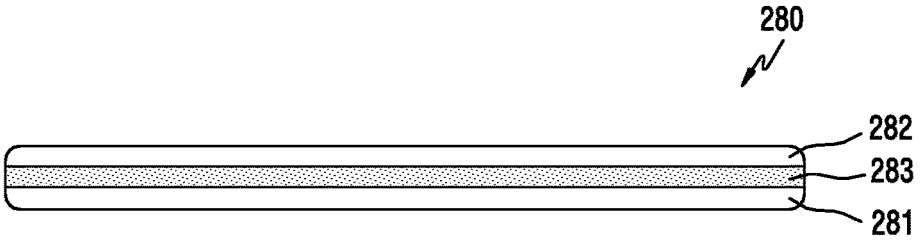
FIG. 2B is a side view of an electronic device according to another embodiment of the present disclosure.

FIG. 2B is a side view of an electronic device 280 according to another illustrative embodiment of the present disclosure. Electronic device 280 may include a first metal ring 281 and a second metal ring 282, each of which is at least partially exposed at a periphery thereof. The first metal ring 281 and the second metal ring 282 may have a filler 283 therebetween, so that the respective metal rings 281 and 282 are disposed separated from each other by a certain distance in the thickness direction of device 280. In the case of FIG. 2B, the first metal ring 281 and the second metal ring 282 do not include any connection portion (such as the connection portions 2302 in the embodiment of FIG. 2A). The rings 281, 282 may be situated separated from each other at "coupling-enabled" positions. In other words, when one of the rings 281 or 282 is suitably driven from an antenna feed so as to resonate as a loop antenna, the other one of the rings 281, 282 may be electromagnetically excited by the near field energy radiated by the driven ring, so as to operate as a parasitic element that also radiates. The resulting combined radiation of both rings 281, 282 may generate a desired antenna performance.

Figure 3:
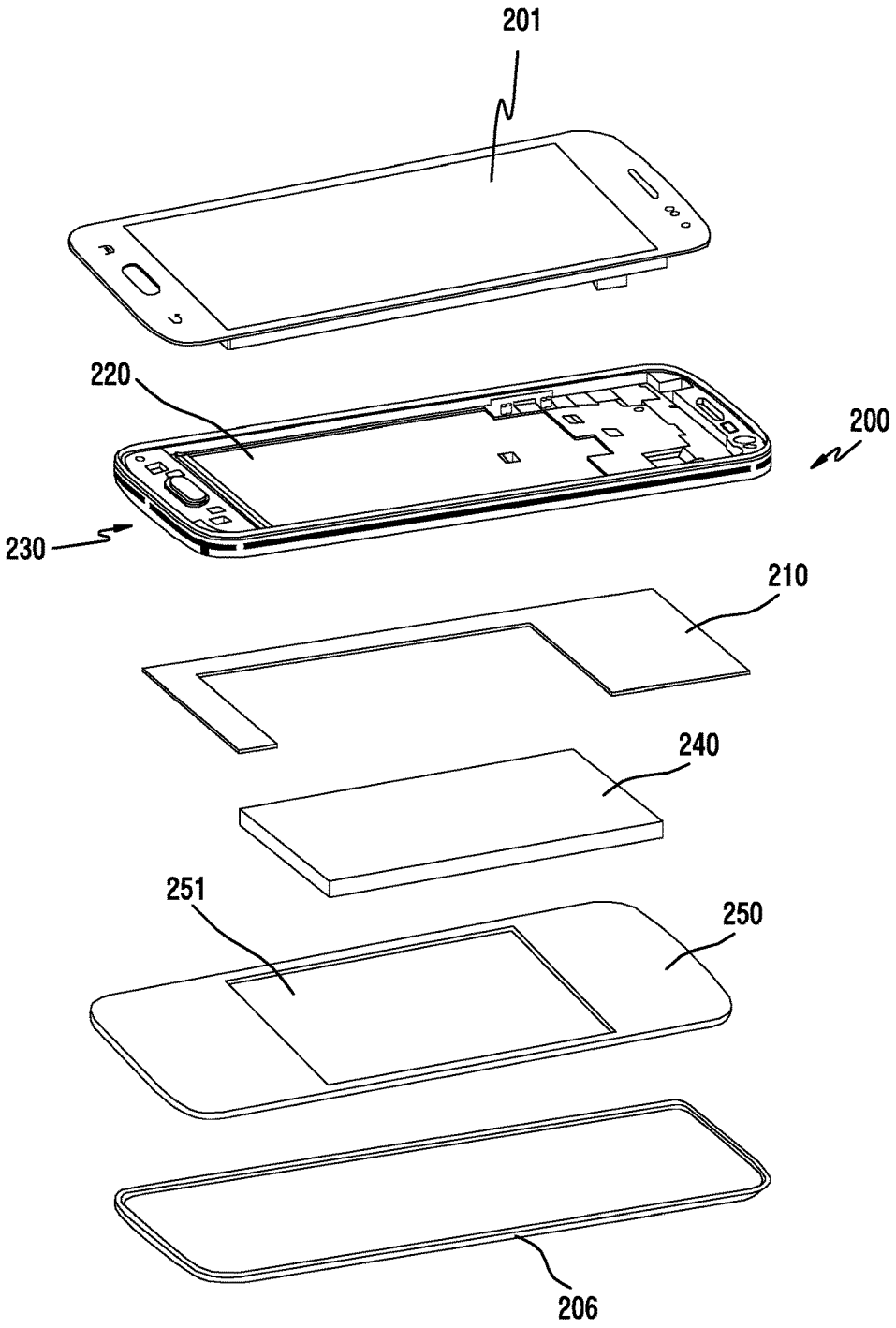
FIG. 3 is an exploded perspective view of an electronic device according to various exemplary embodiments of the present disclosure.

FIG. 3 is an exploded perspective view of the electronic device 200 of FIG. 2A. As seen in FIG. 3, electronic device 200 may include the ring-type antenna 230 circumferentially disposed so as to also serve as a bezel of the electronic device 200. A bracket 220 may be installed in an integral manner, in a separated manner, or in a partially contiguous manner with respect to the ring-type antenna 230. A display 201 may be located at an upper portion of the bracket 220. Device 200 may further include a substrate 210, a battery pack 240, rear housing 250, and battery cover 206 arranged sequentially beneath a lower portion of the bracket 220.

The substrate 210 is, in the example, disposed at an upper portion of the bracket 220. Alternatively, substrate 210 may be located at a lower portion of bracket 220. According to an exemplary embodiment, the battery pack 240 is installed through an opening portion 251 formed in the rear housing 250, but the present disclosure is not limited thereto. In other embodiments, the rear housing structure may not have the opening portion.

The ring-type antenna 230 may include the first metal ring 231 and the second metal ring 232 as illustrated in FIG. 2A (or 2B), and may be installed such that the second metal ring 232 surrounds the metal bracket 220 at approximately the same vertical level (with device 200 oriented horizontally), whereas the second metal ring 232 is at a higher vertical level and is thus spaced vertically from the metal bracket 220. An annular periphery of the metal bracket 220 may be electrically isolated via a suitable isolation means from the inner peripheral surface of the first metal ring 231 (except at one or more connection points, if any are designated). That is, an air gap or an isolating material (not shown) may be provided to separate most or all of the peripheral sides of the metal bracket 220 from the inner peripheral surface of the first metal ring 231.

Figure 4:
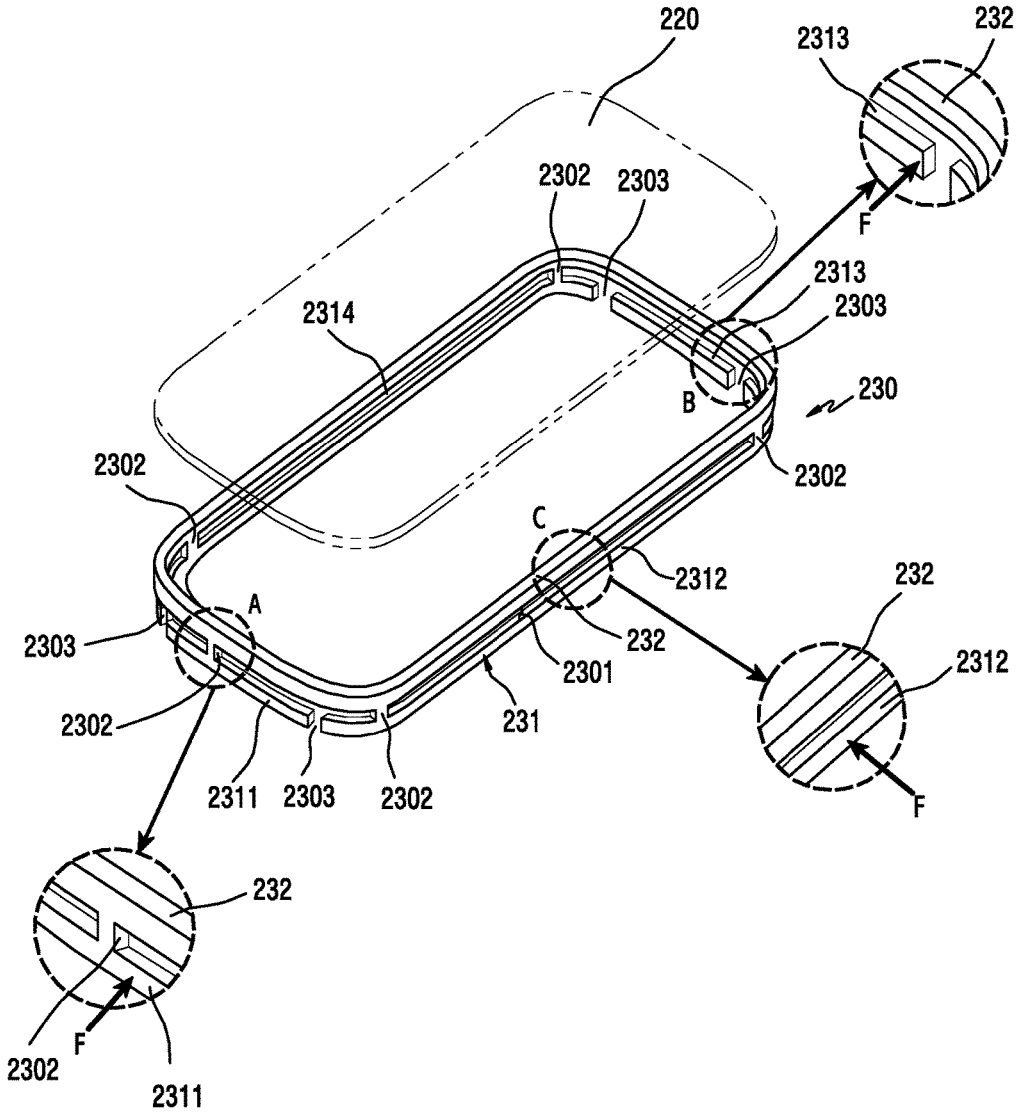
FIG. 4 is a perspective view illustrating important parts of a ring-type antenna according to various exemplary embodiments of the present disclosure.

In the example of FIGS. 2A, 3 and 4, the first metal ring 231, which is the discontinuous ring, may operate as a resonance element, and the second metal ring 232 may operate as a coupled element via electrical connections at the connection portions 2302. The metal bracket 220 may be electrically connected to the second metal ring at one or more connection points. The metal bracket 220 may be formed integrated with or separated from the second metal ring 232. The metal bracket 220 may operate as a separation means capable of enforcing robustness of the electronic device 200 and capable of securing the display 201 and a battery pack (not shown) separated from one another. The first metal ring 231 and the second metal ring 232 may be are coupled by being arranged overlaying each other in a structural relationship, but closely spaced from one another by a specific separation distance in the thickness direction of device 200 (e.g., the specific distance being the vertical dimension of the filler 233. The rings 231, 232 may also be coupled via the connection portions 2302. The structural arrangement of the rings 231, 232 and strategic connection at certain points to an antenna feed and ground surface may realize the antenna 230 operational in a relatively wide frequency band.

FIG. 4 is a perspective view illustrating principal parts of a ring-type antenna 230 according to various exemplary embodiments of the present disclosure. As shown in FIG. 4, the ring-type antenna 230 may have a first metal ring 231 and a second metal ring 232 which oppose each other but are separated by a specific distance in the vertical (thickness) direction so as to form a slit 2301 therebetween. The first metal ring 231 and the second metal ring 232 may be formed in an integral manner. Further, the first metal ring 231 and the second metal ring 232 may be connected to each other at one or more points by the use of at least one connection portion 2302 extended vertically. As noted, the rings 231, 232 may be coupled so that the first metal ring 231 operating as a radiator is oriented in a parallel, opposing relationship with the second metal ring 232 and closely spaced by a uniform distance throughout the structure. However, the present disclosure is not limited thereto, and thus the first metal ring 231 and the second metal ring 232 may be arranged in a non-parallel relationship in other embodiments.

According to an exemplary embodiment, the first metal ring 231 may be provided split into at least two sections (e.g., sections 2311, 2312, 2313, and 2314) by the use of at least one gap 2303. RF signals may be fed to the antenna 230 in at least one portion of the at least one section of the first metal ring 231, so that radiation is achieved via the use of the at least one gap 2303. In FIG. 4, the legend "F" denotes suitable feed points at which first metal ring 231 may be connected to an antenna feed line (RF feed).

In the illustrated embodiment, the first metal ring 231 may include the first section 2311, the second section 2312, the third section 2313, and the fourth section 2314 by the use of the gaps. As illustrated, the four sections 2311, 2312, 2313, and 2314 may be formed by the use of the four gaps 2303. However, the present disclosure is not limited thereto, and thus the first metal ring 231 may include a fewer or greater number of sections by the use of fewer or more gaps.

As noted above, the second metal ring 232 may be arranged in a manner suitable for electrical connection to the metal bracket 220, or it may be arranged in a floating manner with respect to a metal bracket 220. The second metal ring 232 may also be formed in an integral manner with respect to the metal bracket 220. The first metal ring 231 is implemented with the plurality of split sections 2311, 2312, 2313, and 2314 by the use of the plurality of gaps 2303, but an overall shape in which the respective sections are connected may be formed as a shape corresponding to the second metal ring 232. However, the present disclosure is not limited thereto, and thus the first metal ring 231 and the second metal ring 232 may be formed in different shapes. The metal bracket 220 may have a planar shape with generally uniform thickness. However, the present disclosure is not limited thereto, and thus the metal bracket 220 may have heights and thicknesses that vary throughout its geometry or may be formed in various shapes.

According to one exemplary embodiment, the first metal ring 231 is fed at a suitable position in the vicinity of one of the gaps 2303 and a connection portion 2303, whereby the first metal ring 231 resonates as a particular type of antenna. The type of antenna may depend on the RF feeding location and method.

For instance, if an RF feed point is connected to the first section 2311 of the first metal ring 231 in an area A of FIG. 4 (e.g., at the point "F" in area A), an antenna may operate as a Planar Inverted-F Antenna (PIFA) by the use of the neighboring connection portion (section) 2302. That is, the connection section 2302 has a length that extends to the upper ring 232, and a ground connection is made in the vicinity of the upper ring 232 near the junction between the connection section 2302 and the upper ring 232. The connection section 2302 thus serves as a short lineal connection to ground to thereby provide a tuning reactance for the IFA, while the elongated conductive section 2311 resonates.

In another feeding scheme, if the RF feed point is connected to the third section 2313 of the first metal ring 231 in an area B of FIG. 4 (e.g. at the point "F" in area B), the antenna may operate as a monopole antenna. It is seen that the third section 2313 is a lineal section electrically isolated from the upper ring 232 and also electrically isolated on opposite ends thereof from the other sections of the lower ring 231 by virtue of the gaps 2303 at each end. Thus by connecting the third section 2313 at the point F to an RF signal line of a two conductor transmission line such as a coaxial feed or microstrip section, and suitably grounding the other conductor of the two line transmission line, the section 2313 may be driven as a monopole. (It is noted here that the third section 2313 is shown "floating" in FIG. 4 but may be suitably supported to the rest of the ring antenna structure by attached non-conductive material (not shown) in between the gaps on the left and right sides and/or the slit seen between the section 2313 and the upper ring 232.)

In a further embodiment, if the RF feed point is connected to the second section 2312 of the first metal ring 231 in an area C of FIG. 4, the antenna may operate as a loop-type antenna by the use of the connection portion 2302 placed to each of left and right sides of the feed position.

According to various exemplary embodiments, the ring-type antenna 230 may operate as various types of antennas in various bands, and may be utilized as a multi-band antenna which is at least two antennas operating in two or more bands.

Figure 7:
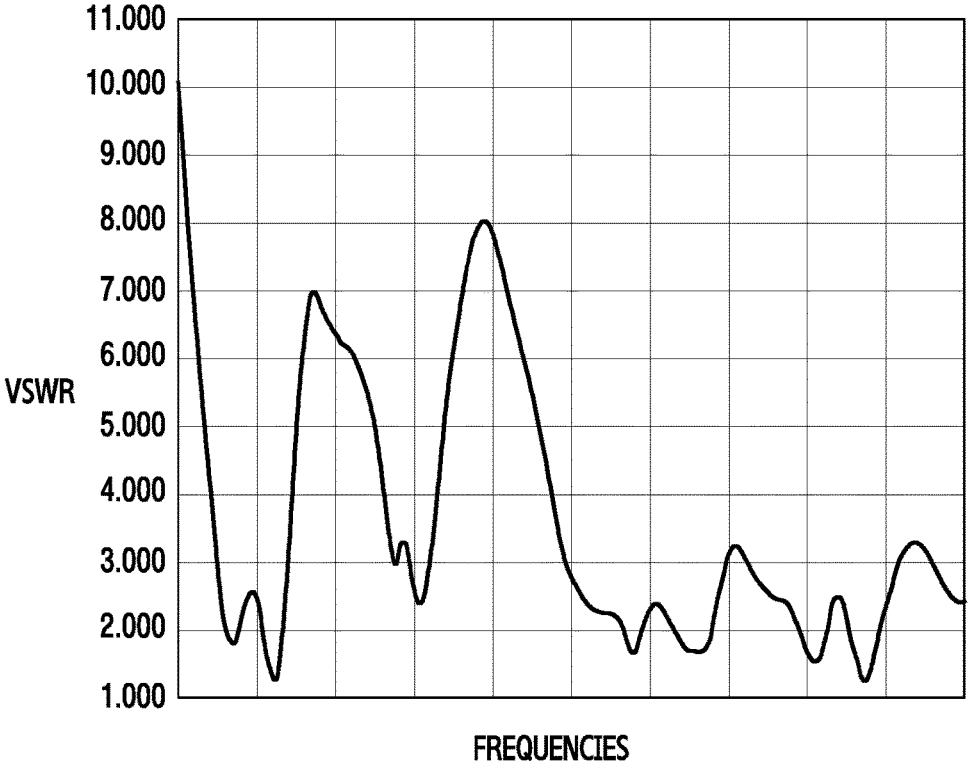
FIG. 7 is a graph illustrating a Voltage Standing Wave Ratio (VSWR) of a ring-type antenna as a function of frequency, operating as an antenna radiator according to various exemplary embodiments of the present disclosure.

FIG. 7 is a graph illustrating a Voltage Standing Wave Ratio (VSWR) of the ring-type antenna 230 operating as an antenna radiator according to an exemplary embodiment of the present disclosure. It can be seen that the antenna operates as a multi-band antenna since low VSWR appears in various primary frequency bands currently in use among bands in the range of 700 MHz~2.3 GHz.

In addition, as illustrated in Table 1 below, it can be seen that smooth Total Radiation Power (TRP) appears when it is measured at a level of a rotation angle of 30 degrees in various bands in free space.

TABLE 1

900/1800 TRP
Total Radiated Power (TRP, 30 degrees)

| Band | OSM900 | | | DCS | | |
|---|---|---|---|---|---|---|
| Channel | 975 | 37 | 124 | 512 | 899 | 885 |
| TX Frequency (MHz) | 880.2 | 897.4 | 914.8 | 1710.2 | 1747.8 | 1784.8 |
| TRP (dBm), 38 degree | 25.69 | 25.46 | 27.21 | 24.32 | 24.52 | 24.13 |

WCDMA B1 TRP
Total Radiated Power (TRP, 30 degrees)

| Band | Band 1 Band | | |
|---|---|---|---|
| Channel | 9614 | 9750 | 9888 |
| TX Frequency (MHz) | 1922.8 | 1950 | 1977.8 |
| TRP (dBm), 38 degree | 16.12 | 16.89 | 17.94 |

LTE B7 TRP
Total Radiated Power (TRP, 30 degrees)

| Band | E-UTRA Band 7 | | |
|---|---|---|---|
| Channel | 20800 | 21100 | 21400 |
| TRP (dBm), 38 degree | 12.52 | 14.78 | 15.34 |

TABLE 1-continued

| LTE B20 TRP Total Radiated Power (TRP, 30 degrees) | | | | LTE B3 TRP Total Radiated Power (TRP, 30 degrees) | | | |
|---|---|---|---|---|---|---|---|
| Band | E-UTRA Band 20 | | | Band | E-UTRA Band 3 | | |
| Channel | 24200 | 24300 | 24400 | Channel | 19250 | 19575 | 19900 |
| TRP (dBm), 38 degree | 15.88 | 15.87 | 15.64 | TRP (dBm), 38 degree | 16.24 | 16.84 | 16.87 |

Passive

| | | | | | | | | | | |
|---|---|---|---|---|---|---|---|---|---|---|
| Frequency [MHz] | 791 | 821 | 832 | 862 | 880 | 915 | 925 | 960 | 1710 | 1785 |
| Efficiency [dB] | −12.29 | −8.96 | −8.38 | −7.44 | −7.30 | −6.86 | −6.88 | −6.90 | −7.77 | −5.68 |
| Efficiency [%] | 5.90 | 12.71 | 14.52 | 18.02 | 18.61 | 20.60 | 20.53 | 20.42 | 16.73 | 27.05 |
| Frequency [MHz] | 1805 | 1880 | 1920 | 1980 | 2110 | 2170 | 2500 | 2570 | 2620 | 2690 |
| Efficiency [dB] | −5.16 | −5.98 | −6.66 | −5.32 | −8.82 | −10.46 | −9.20 | −6.36 | −7.58 | −7.37 |
| Efficiency [%] | 30.50 | 25.21 | 21.60 | 29.41 | 13.13 | 8.99 | 12.03 | 23.14 | 17.47 | 18.32 |

Figure 5:
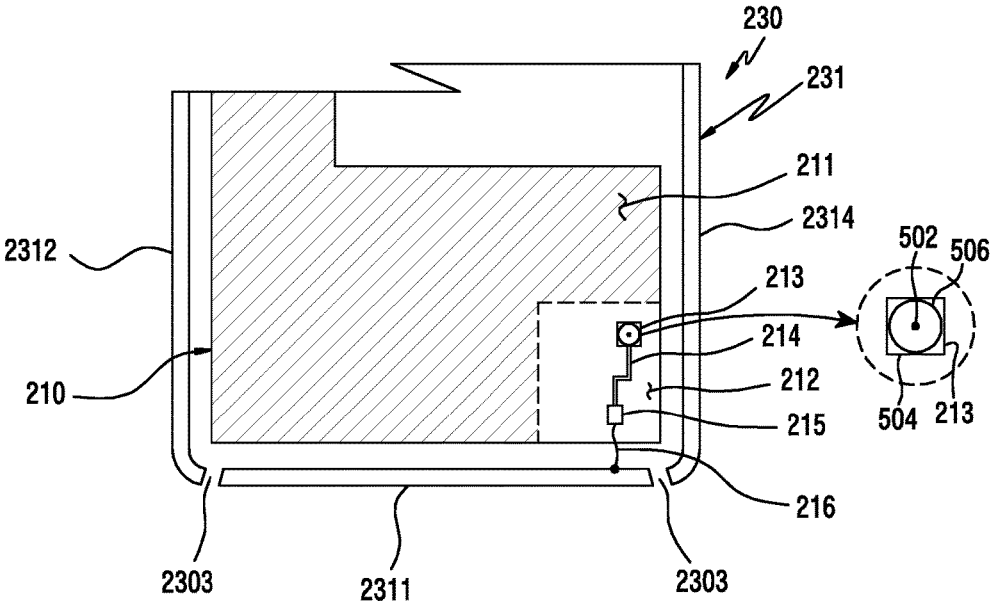
FIG. 5 is a view illustrating principal parts in a state where a ring-type antenna is fed in a substrate according to various exemplary embodiments of the present disclosure.

FIG. 5 is a view illustrating principal parts of a ring-type antenna 230 in a state where the antenna 230 is fed from an RF feed in a substrate 210 according to various exemplary embodiments of the present disclosure. Substrate 210 may include a ground area 211 and a non-ground area (e.g., a "fill-cut" area) 212. The non-ground area 212 may include an RF feeder 213 for feeding RF signals to a first metal ring 231 of the ring-type antenna. The feeder 213 located at the non-ground area 212 and the first metal ring 231 may be electrically connected by means of an electrical connection member 216.

More specifically, the feeder 213 may be a two conductor transmission line such as a coaxial line as shown, with an inner conductor 502, an outer conductor 506 and a dielectric material 504 separating the inner and outer conductors 502, 504. Other types of transmission lines are possible as well. The inner conductor 502 may be galvanically connected to the first metal ring 231 through the connection member 216, while the outer conductor is connected to the ground surface 211 or other ground point connected to the ground surface 211. Electrical connection between the inner conductor 502 and the metal ring 231 may be achieved by means of a specific conductive trace 214 on the substrate 210 from the inner conductor 502 of feeder 213 to a connection pad 215 near the first metal ring 231, and then to the first metal ring 231 by means of the electrical connection member 216. In an alternative connection scheme, a physical connection may be made directly from the feeder 213 to the ring 231 by means of the electrical connection member 216, i.e., without the conductive trace 214/pad 215. In another connection scheme, the first metal ring 231 may be connected to the feeder 213 of the substrate 210 directly in a physical manner without an additional electrical connection member. Further, at least one matching element 215 (also serving as the above-noted pad) may be disposed between the electrical connection member 216 and the feeder 213 to adjust an operation frequency band of the first metal ring 231 or to adjust an operating bandwidth. Various conductive materials such as a session cable, a flexible printed circuit board, a coaxial cable, a C-clip, and the like may be used as the electrical connection member 216.

Figure 6:
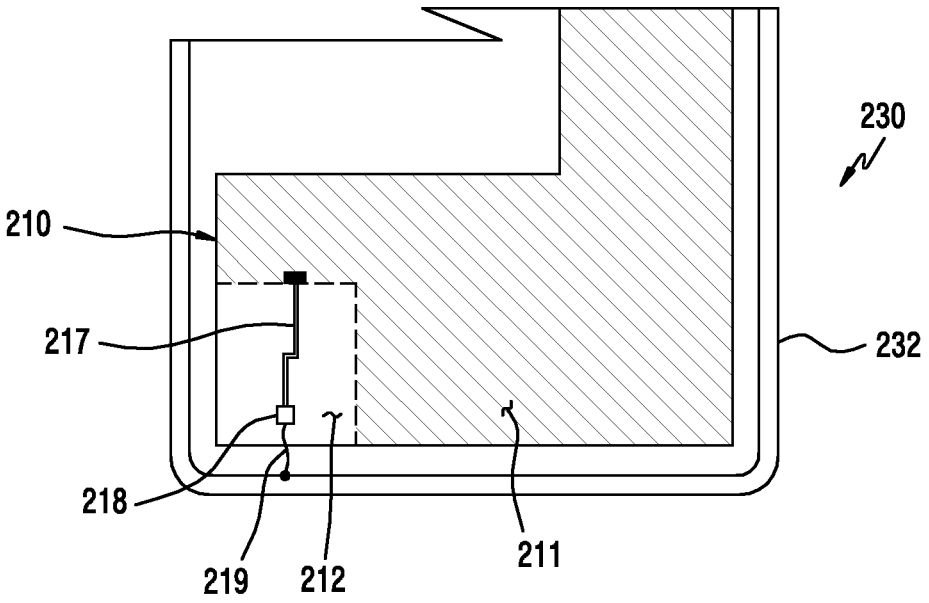
FIG. 6 is a view illustrating principal parts in a state where a ring-type antenna is grounded to a substrate according to various exemplary embodiments of the present disclosure.

FIG. 6 is a view illustrating principal parts in a state where a ring-type antenna 230 is grounded to a substrate 210 according to various exemplary embodiments. FIG. 6 may be considered a rear view of the portion of device 200 seen in the view of FIG. 5. The connection to the upper ring 232 shown in FIG. 6 may be made in conjunction with the connection to the lower ring 231 seen in FIG. 5. As shown in FIG. 6, the substrate 210 may include a ground area 211 and a non-ground area (e.g., "fill-cut" area) 212. The ground area 211 may be electrically connected to the second metal ring 232 of the ring-type antenna 230 by means of an electrical connection member 219. An electrical connection may be achieved by means of a specific conductive trace 217 from the ground area 211 of the substrate 210 to a connection pad 218 near the second metal ring 232, and then to the second metal ring 232 by means of the electrical connection member 219. However, the present disclosure is not limited thereto, and thus the electrical connection member 219 may be electrically connected directly to the ground area 211 without traversing the non-ground area 212 of the substrate 210. In another implementation, the second metal ring 232 may be connected to the ground area 211 of the substrate 210 directly in a physical manner without having to use an additional electrical connection member. According to an exemplary embodiment, at least one matching element 218 (also serving as the connection pad noted above) is disposed between the ground area 211 and the electrical connection member 219, to adjust an operation frequency band of the first metal ring 231 or to adjust a bandwidth. Various conductive materials such as a session cable, a flexible printed circuit board, a coaxial cable, a C-clip, and the like may be used as the electrical connection member 219.

According to an exemplary embodiment described above, the second metal ring 232 is electrically connected to the ground area 211 of the substrate 210, but other connection schemes are possible. For example, the second metal ring 232 may be galvanically and electrically connected to each of the ground area 211 of the substrate 210 and a metal bracket (see 220 of FIG. 4). According to another exemplary embodiment, the second metal ring 232 may be electrically connected to the ground area 211 of the substrate 210 electronically connected to the metal bracket 220 acting as an ground. The second metal ring 232 may be electrically connected only to the metal bracket 220 and not to the substrate 210 (and in this case, the metal bracket may be directly connected to the ground area 211).

According to various exemplary embodiments, there may be provided an electronic device including a metal bracket, a second metal ring placed closely around an edge of the metal bracket, and a first metal ring which is disposed in a separated manner, spaced by a specific distance in an opposing relationship with respect to the second metal ring and formed at least in two sections by the use of at least one gap, and of which an overall shape includes a first metal ring matched to the second metal ring, wherein the first metal ring includes an antenna operating as a radiator by feeding at least one portion thereof.

According to various exemplary embodiments, there may be provided an electronic device including a display, a metal bracket for supporting the display, a second metal ring formed around an edge of the metal bracket, a first metal ring which is placed in a separated manner with a specific interval with respect to the second metal ring and formed at least in two pieces by the use of at least one gap, and of which an overall shape includes a first metal ring matched to the second metal ring, a substrate including a feeder for feeding the first metal ring, and wherein the first metal ring operates as a radiator.

According to various exemplary embodiments of the present disclosure, a antenna with a ring-type structure is utilized as a part of an external appearance or a part of a housing of an electronic device and also used as an antenna for the device. Therefore, since an additional antenna may not be placed inside the electronic device, a space otherwise allocated for an internal antenna may be eliminated or partially used for other components, thereby contributing to slimming down the size of the electronic device.

Figure 8:
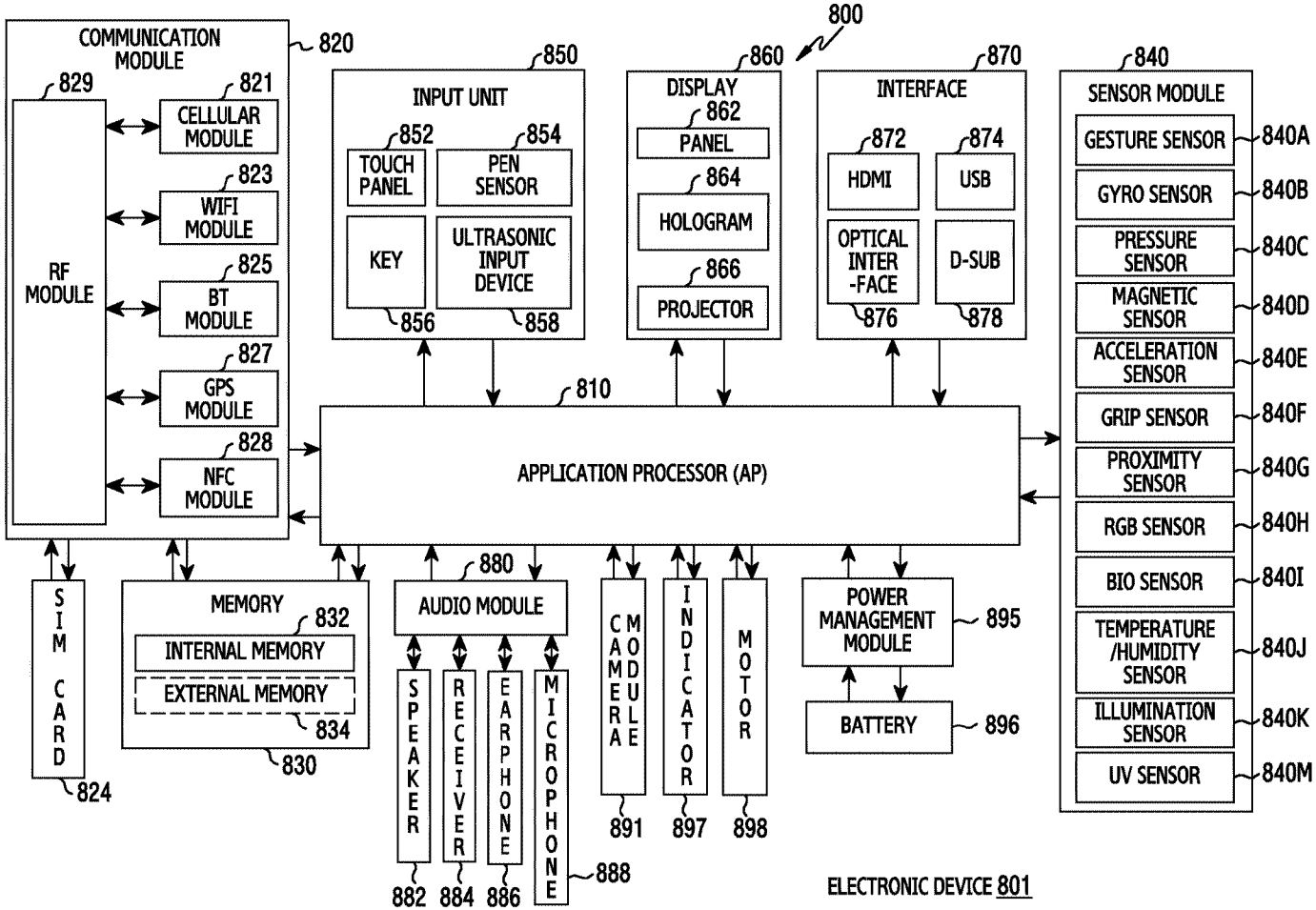
FIG. 8 illustrates a block diagram of an electronic device according to various exemplary embodiments of the present disclosure.

FIG. 8 illustrates a block diagram 800 of an electronic device 801 according to various exemplary embodiments of the present disclosure. As shown in FIG. 8, the electronic device 801 may entirely or partially constitute, for example, the electronic device 101 of FIG. 1, the device 200 of FIG. 2A or the device 280 of FIG. 2B. Electronic device 801 includes at least one Application Processor (AP) 810, a communication module 820, a Subscriber Identification Module (SIM) card 824, a memory 830, a sensor module 840, an input unit 850, a display 860, an interface 870, an audio module 880, a camera module 891, a power management module 895, a battery 896, an indicator 897, and a motor 898.

The AP 810 may control a plurality of hardware or software constitutional elements connected to the AP 810 by driving an operating system or an application program, and may process a variety of data including multimedia data and may perform an arithmetic operation. The AP 810 may be implemented, for example, with a System on Chip (SoC). The AP 810 may further include a Graphic Processing Unit (GPU, not shown).

The communication module 820 (e.g., the communication interface 160) may perform data transmission/reception in communication between other electronic devices (e.g., the electronic device 104 or the server 106) connected with the electronic device 801 (e.g., the electronic device 101) through a network, the communication module 820 may include a cellular module 821, a Wi-Fi module 823, a BlueTooth (BT) module 825, a Global Positioning System (GPS) module 827, a Near Field Communication (NFC) module 828, and a Radio Frequency (RF) module 829.

The cellular module 821 may provide a voice call, a video call, a text service, an internet service, and the like through a communication network (e.g., LTE, LTE-A, CDMA, WCDMA, UMTS, WiBro, GSM, etc.). In addition, the cellular module 821 may identify and authenticate the electronic device within the communication network by using a subscriber identity module (e.g., the SIM card 824), the cellular module 821 may perform at least some of functions that can be provided by the AP 810. For example, the cellular module 821 may perform at least some of multimedia control functions.

The cellular module 821 may include a Communication Processor (CP). Further, the cellular module 821 may be implemented, for example, with an SoC. Although constitutional elements such as the cellular module 821 (e.g., the communication processor), the memory 830, the power management module 895, and the like are illustrated as separate constitutional elements with respect to the AP 810 in FIG. 8, the AP 810 may also be implemented such that at least one part (e.g., the cellular module 821) of the aforementioned constitutional elements is included.

The AP 810 or the cellular module 821 (e.g., the communication processor) may load an instruction or data, which is received from each non-volatile memory connected thereto or at least one of different constitutional elements, to a volatile memory and may process the instruction or data. In addition, the AP 810 or the cellular module 821 may store data, which is received from at least one of different constitutional elements or generated by at least one of different constitutional elements, into the non-volatile memory.

Each of the WiFi module 823, the BT module 825, the GPS module 827, and the NFC module 828 may include, for example, a processor for processing data transmitted/received through a corresponding module. Although the cellular module 821, the WiFi module 823, the BT module 825, the GPS module 827, and the NFC module 828 are illustrated in FIG. 8 as separate blocks, according to one exemplary embodiment, at least some (e.g., two or more) of the cellular module 821, the WiFi module 823, the BT module 825, the GPS module 827, and the NFC module 828 may be included in one Integrated Chip (IC) or IC package. For example, at least some of processors corresponding to the cellular module 821, the WiFi module 823, the BT module 825, the GPS module 827, and the NFC module 828 (e.g., a communication processor corresponding to the cellular module 821 and a WiFi processor corresponding to the WiFi module 823) may be implemented with an SoC.

The RF module 829 may serve to transmit/receive data, for example, to transmit/receive an RF signal. Although not shown, the RF module 829 may include, for example, a transceiver, a Power Amp Module (PAM), a frequency filter, a Low Noise Amplifier (LNA), and the like. In addition, the RF module 829 may further include a component for transmitting/receiving a radio wave on a free space in wireless communication, for example, a conductor, a conducting wire, and the like. Although it is illustrated in FIG. 8 that the cellular module 821, the WiFi module 823, the BT module 825, the GPS module 827, and the NFC module 828 share one RF module 829, according to one exemplary embodiment, at least one of the cellular module 821, the WiFi module 823, the BT module 825, the GPS module 827, the NFC module 828 may transmit/receive an RF signal via a separate RF module.

The SIM card 824 may be a card in which a SIM is implemented, and may be inserted to a slot formed at a specific location of the electronic device. The SIM card 824 may include unique identification information (e.g., an Integrated Circuit Card IDentifier (ICCID)) or subscriber information (e.g., an International Mobile Subscriber Identity (IMSI)).

The memory 830 (e.g., the memory 130) may include an internal memory 832 or an external memory 834. The internal memory 832 may include, for example, at least one of a volatile memory (e.g., a Dynamic RAM (DRAM), a Static RAM (SRAM), a Synchronous Dynamic RAM (SDRAM), etc.) or a non-volatile memory (e.g., a One Time Programmable ROM (OTPROM), a Programmable ROM (PROM), an Erasable and Programmable ROM (EPROM), an Electrically Erasable and Programmable ROM (EEPROM), a Mask ROM, a Flash ROM, a NAND flash memory, a NOR flash memory, etc.).

The internal memory 832 may be a Solid State Drive (SSD). The external memory 834 may further include a flash drive, and may further include, for example, Compact Flash (CF), Secure Digital (SD), Micro Secure Digital (Micro- SD), Mini Secure digital (Mini-SD), extreme Digital (xD), memory stick, and the like. The external memory 834 may be operatively coupled to the electronic device 801 via various interfaces. The electronic device 801 may further include a storage unit (or a storage medium) such as a hard drive.

The sensor module 840 may measure a physical quantity or detect an operation state of the electronic device 801, and thus may convert the measured or detected information into an electric signal. The sensor module 840 may include, for example, at least one of a gesture sensor 840A, a gyro sensor 840B, a pressure sensor 840C, a magnetic sensor 840D, an acceleration sensor 840E, a grip sensor 840F, a proximity sensor 840G, a color sensor 840H (e.g., a Red, Green, Blue (RGB) sensor), a bio sensor 840I, a temperature/humidity sensor 840J, an illumination sensor 840K, and an Ultra Violet (UV) sensor 840M. Additionally or alternatively, the sensor module 840 may include, for example, an E-node sensor (not shown), an ElectroMyoGraphy (EMG) sensor (not shown), an ElectroEncephaloGram (EEG) sensor (not shown), an ElectroCardioGram (ECG) sensor (not shown), a fingerprint sensor, etc. The sensor module 840 may further include a control circuit for controlling at least one or more sensors included therein.

The input module 850 may include a touch panel 852, a (digital) pen sensor 854, a key 856, or an ultrasonic input unit 858. The touch panel 852 may recognize a touch input, for example, by using at least one of an electrostatic type, a pressure-sensitive type, and an ultrasonic type. The touch panel 852 may further include a control circuit. In case of the electrostatic type, not only a physical contact but also a proximity recognition is also possible. The touch penal 852 may further include a tactile layer. In this case, the touch panel 852 may provide the user with a tactile reaction.

The (digital) pen sensor 854 may be implemented, for example, by using the same or similar method of receiving a touch input of the user or by using an additional sheet for recognition. The key 856 may be, for example, a physical button, an optical key, a keypad, or a touch key. The ultrasonic input unit 858 is a device by which the electronic device 801 detects a sound wave through a microphone (e.g., a microphone 888) by using a pen which generates an ultrasonic signal, and is a device capable of radio recognition. The electronic device 801 may use the communication module 820 to receive a user input from an external device (e.g., a computer or a server) connected thereto.

The display 860 (e.g., the display 150) may include a panel 862, a hologram 864, or a projector 866. The panel 862 may be, for example, a Liquid-Crystal Display (LCD), an Active-Matrix Organic Light-Emitting Diode (AM-OLED), etc. The panel 862 may be implemented, for example, in a flexible, transparent, or wearable manner. The panel 862 may be constructed as one module with the touch panel 852. The hologram 864 may use an interference of light and show a stereoscopic image in the air. The projector 866 may display an image by projecting a light beam onto a screen. The screen may be located, for example, inside or outside the electronic device 801. The display 860 may further include a control circuit for controlling the panel 862, the hologram 864, or the projector 866.

The interface 870 may include, for example, a High-Definition Multimedia Interface (HDMI) 872, a Universal Serial Bus (USB) 874, an optical communication interface 876, or a D-subminiature (D-sub) 878. The interface 870 may be included, for example, in the communication interface 160 of FIG. 1. Additionally or alternatively, the interface 870 may include, for example, Mobile High-definition Link (MHO (not shown), Secure Digital (SD)/Multi-Media Card (MMC) (not shown) or Infrared Data Association (IrDA) (not shown).

The audio module 880 may bilaterally convert a sound and electric signal. At least some constitutional elements of the audio module 808 may be included in, for example, the input/output interface 140 of FIG. 1. The audio module 880 may convert sound information which is input or output, for example, through a speaker 882, a receiver 884, an earphone 886, the microphone 888, and the like.

The camera module 891 is a device for image and video capturing, and according to one exemplary embodiment, may include one or more image sensors (e.g., a front sensor or a rear sensor), a lens (not shown), an Image Signal Processor (ISP) (not shown), or a flash (not shown, e.g., LED or xenon lamp).

The power management module 895 may manage power of the electronic device 801. Although not shown, the power management module 895 may include, for example, a Power Management Integrated Circuit (PMIC), a charger Integrated Circuit (IC), or a battery fuel gauge.

The PMIC may be placed, for example, inside an IC or SoC semiconductor. Charging may be classified into wired charging and wireless charging. The charger IC may charge a battery, and may avoid an over-voltage or over-current flow from a charger. The charger IC may further include a charger IC for at least one of the wired charging and the wireless charging. The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge may measure, for example, a residual quantity of the battery 896 and a voltage, current, and temperature during charging. The battery 896 may store or generate electricity, and may supply power to the electronic device 801 by using the stored or generated electricity. For example, the battery 896 may include a rechargeable battery or a solar battery.

The indicator 897 may indicate a specific state, for example, a booting state, a message state, a charging state, and the like, of the electronic device 801 or a part thereof (e.g., the AP 810). The motor 898 may convert an electric signal into a mechanical vibration. Although not shown, the electronic device 801 may include a processing unit (e.g., a GPU) for supporting mobile TV. The processing unit for supporting mobile TV may process media data according to a protocol of, for example, Digital Multimedia Broadcasting (DMB), Digital Video Broadcasting (DVB), media flow, and the like.

Each of the aforementioned constitutional elements of the electronic device according to various exemplary embodiments of the present disclosure may consist of one or more components, and names thereof may vary depending on a type of electronic device. The electronic device according to various exemplary embodiments of the present disclosure may include at least one of the aforementioned constitutional elements. Some of the constitutional elements may be omitted, or additional other constitutional elements may be further included. In addition, some of the constitutional elements of the electronic device according to various exemplary embodiments of the present disclosure may be combined and constructed as one entity, so as to equally perform functions of corresponding constitutional elements before combination.

A term "module" used in various exemplary embodiments of the present document may imply a unit including, for example, one of hardware, software, and firmware or a combination of two or more of them. The "module" may be interchangeably used with a term such as a unit, a logic, a logical block, a component, a circuit, and the like. The "module" may be a minimum unit of an integrally constituted component or may be a part thereof. The "module" may be a minimum unit for performing one or more functions or may be a part thereof. The "module" may be mechanically or electrically implemented. For example, the "module" of the present disclosure may include at least one of an Application-Specific Integrated Circuit (ASIC) chip, a Field-Programmable Gate Arrays (FPGAs), and a programmable-logic device, which are known or will be developed and which perform certain operations.

According to various exemplary embodiments, at least some parts of a device (e.g., modules or functions thereof) or method (e.g., operations) according to various exemplary embodiments of the present disclosure may be implemented with an instruction stored in a computer-readable storage media for example. If the instruction is executed by one or more processors (e.g., the processor 810), the one or more processors may perform a function corresponding to the instruction. The computer-readable storage media may be, for example, the memory 830. At least some parts of the programming module may be implemented (e.g., executed), for example, by the processor 810. At least some parts of the programming module may include modules, programs, routines, sets of instructions, processes, and the like, for performing one or more functions.

The computer readable recording medium may be a hardware device configured particularly to store and perform a program instruction (e.g., program module), for example, a hard disk, a magnetic medium such as a floppy disc and a magnetic tape, an optical storage medium such as a Compact Disc-ROM (CD-ROM) or a Digital Versatile Disc (DVD), a magnetic-optic medium such as a floptical disc, a Read Only Memory (ROM), a Random Access Memory (RAM), a flash memory, and the like. An example of the program instruction includes not only a machine language created by a compiler but also a high-level language executable by a computer by using an interpreter or the like. The aforementioned hardware device may be configured to operate as one or more software modules to perform the operation of the present disclosure, and the other way around is also possible.

The module or programming module according to various exemplary embodiments of the present disclosure may further include at least one or more constitutional elements among the aforementioned constitutional elements, or may omit some of them, or may further include additional other constitutional elements. Operations performed by a module, programming module, or other constitutional elements according to various exemplary embodiments of the present disclosure may be executed in a sequential, parallel, repetitive, or heuristic manner. In addition, some of the operations may be executed in a different order or may be omitted, or other operations may be added.

While the present disclosure has been shown and described with reference to certain preferred embodiments thereof, it will be understood by those skilled in the art that various changes in form and details may be made therein without departing from the spirit and scope of the disclosure as defined by the appended claims. Therefore, the scope of the present disclosure is defined not by the detailed description of the present disclosure but by the appended claims, and all differences within the scope will be construed as being included in the present disclosure.

What is claimed is:

1. A portable communication device comprising:

a display forming a first portion of an outer surface of the portable communication device;

a ground plane disposed in an interior of the portable communication device;

a first conductive member forming a second portion of the outer surface of the portable communication device and adapted to provide a radiation characteristic with respect to the portable communication device; and a second conductive member coupled with the ground plane, and forming a third portion of the outer surface of the portable communication device, and disposed to be at least partially overlapped with the first conductive member when viewed from above the display, wherein the first conductive member and the second conductive member are positioned at a periphery of the portable communication device.

2. The portable communication device of claim 1, wherein the first conductive member includes at least one gap.

3. The portable communication device of claim 1, further comprising a feed line coupled with the first conductive member, and wherein the first conductive member is adapted to provide the radiation characteristic using a power supplied via the feed line.

4. The portable communication device of claim 1, wherein the first conductive member is adapted to radiate as at least part of a planar inverted-F antenna, as at least part of the providing.

5. The portable communication device of claim 1, wherein the first conductive member or the second conductive member is at least partially composed of a metal material.

6. The portable communication device of claim 1, further comprising a supporting member disposed in the interior of the portable communication device and coupled with the second conductive member.

7. The portable communication device of claim 6, wherein the second conductive member and the supporting member are formed as an integral structure.

8. The portable communication device of claim 7, wherein the second conductive member forms at least one planar-shaped portion of the integral structure.

9. The portable communication device of claim 6, wherein the supporting member comprises a metal bracket.

10. The portable communication device of claim 6, wherein the supporting member is electrically coupled with the ground plane.

11. The portable communication device of claim 1, wherein the first conductive member and the second conductive member are formed in different shapes.

12. The portable communication device of claim 1, wherein the second conductive member is coupled with the ground plane via an electrical connector, the electrical connector comprising a session cable, a flexible printed circuit board, a coaxial cable, a C-clip, or any combination thereof.

13. The portable communication device of claim 1, further comprising a non-conductive member disposed between the first conductive member and the second conductive member, and wherein the first conductive member is separated from the second conductive member by the non-conductive member.

14. The portable communication device of claim 13, wherein the non-conductive member is formed in an insert molding manner.

15. The portable communication device of claim 1, wherein first conductive member is substantially orthogonal to the display.

16. The portable communication device of claim 1, wherein the second conductive member is substantially parallel to the display.

17. A portable communication device comprising:

a circuit board housed in the portable communication device and including a feed line and a ground plane;

a supporting member positioned adjacent to the circuit board and adapted to support the circuit board;

a first conductive member forming a first portion of a periphery disposed about an outer surface of the portable communication device and adapted to provide a radiation characteristic with respect to the portable communication device using a power supplied via the feed line; and a second conductive member coupled with the ground plane and the supporting member, and forming a second portion of the periphery disposed about the outer surface of the portable communication device, wherein at least one portion of the second conductive member is disposed in a vertically overlapping manner with respect to the first conductive member.

18. The portable communication device of claim 17, wherein the second conductive member is formed in an integral manner with respect to the supporting member.

19. The portable communication device of claim 17, wherein the supporting member is electrically coupled with at least one portion of the ground plane.

20. The portable communication device of claim 17, wherein the first conductive member and the second conductive member are formed in different shapes.

21. A portable communication device comprising:

a display visually exposed through a first portion of an outer surface of the portable communication device;

a circuit board housed in the portable communication device and including a feed line and a ground plane;

a metal member including a first portion and a second portion, the first portion positioned adjacent to the circuit board and adapted to support the circuit board, the second portion coupled with the ground plane and forming a second portion of the outer surface; and a conductive member forming a third portion of the outer surface, and adapted to provide a radiation characteristic with respect to the portable communication device using a power supplied via the feed line, and disposed to be at least partially overlapped with the second portion of the metal member when viewed from above the display, wherein the second portion of the metal member and the conductive member are positioned at a periphery of the portable communication device.

* * * * *